US005646483A

United States Patent [19]

Myojo et al.

[11] Patent Number: 5,646,483

[45] Date of Patent: Jul. 8, 1997

[54] DISCHARGE LAMP HAVING CESIUM COMPOUND

[75] Inventors: Minoru Myojo, Takatsuki; Haruo Yamazaki, Moriyama; Toshiyuki Namura, Takatsuki, all of Japan

[73] Assignee: Matsushita Electronics Corporation, Osaka, Japan

[21] Appl. No.: 452,488

[22] Filed: May 30, 1995

[51] Int. Cl.[6] ..... H01J 17/30; H01J 17/46; H01J 61/54

[52] U.S. Cl. ..... 313/595; 313/596; 313/601

[58] Field of Search ..... 313/550, 551, 313/594, 595, 630, 490, 491, 492, 493, 601, 596, 597, 572, 631, 636

[56] References Cited

U.S. PATENT DOCUMENTS

| | | | |
|---|---|---|---|
| 2,663,823 | 12/1953 | Elenbaas et al. | 313/596 X |
| 2,754,442 | 7/1956 | Boutry | 313/550 |
| 2,829,295 | 4/1958 | Gast et al. | 313/596 X |
| 2,930,934 | 3/1960 | Wainio et al. | 313/596 X |
| 3,319,119 | 5/1967 | Rendina | 313/572 |
| 3,479,550 | 11/1969 | Frohner | 313/550 |
| 3,487,252 | 12/1969 | Pollock | 313/550 |
| 4,129,802 | 12/1978 | Vienken et al. | 313/596 X |
| 4,233,653 | 11/1980 | Jangerius et al. | 313/596 X |
| 4,275,330 | 6/1981 | Cho et al. . | |
| 4,359,668 | 11/1982 | Ury . | |
| 4,924,142 | 5/1990 | Kaldenhoven | 313/639 |
| 5,363,015 | 11/1994 | Dakin | 313/638 |
| 5,391,960 | 2/1995 | Moribayashi et al. | 313/601 X |

FOREIGN PATENT DOCUMENTS

| | | |
|---|---|---|
| 55-143768A | 11/1980 | Japan . |
| 5-290811A | 11/1993 | Japan . |

OTHER PUBLICATIONS

Journal of the Illuminating Engineering Society Article, Summer 1990 (pp. 76–83) —Titled Zaslavsky et al., "Improved Starting of the 100–W Metal Halide Lamp".

*Primary Examiner*—Sandra L. O'Shea
*Assistant Examiner*—Mack Haynes
*Attorney, Agent, or Firm*—Fish & Richardson P.C.

[57] ABSTRACT

A discharge lamp or an electrodeless discharge lamp including a discharge gas filled inside a bulb, an electrode part present inside the bulb for emitting thermoelectrons into the discharge gas, and a cesium compound placed in a position other than the electrode part inside the bulb. According to this configuration, this discharge lamp has a short starting delay time even at a low temperature including room temperature, without using any starting auxiliary light source or a radioactive material. The cesium compound is contained on the surface of a metal mesh which is fixed via a supporting arm in a position avoiding the electrode part inside the bulb. It is preferable that the cesium oxide is in contact with the discharge space. In this way, starting property can be improved without using any starting auxiliary light source or a radioactive material. The electrodeless discharge lamp has the cesium compound at an optional position in the discharge space.

15 Claims, 4 Drawing Sheets

DISCHARGE LAMP HAVING CESIUM COMPOUND

FIELD OF THE INVENTION

This invention relates to a discharge lamp, such as a cold-cathode fluorescent lamp or an electrodeless fluorescent lamp, which has improved starting capability. More particularly, this invention relates to a discharge lamp filled with a cesium compound such as cesium oxide inside a bulb.

BACKGROUND OF THE INVENTION

Conventionally, a method of impregnating a cathode with cesium oxide having a relatively small work function is proposed for improving the starting capability of a cold-cathode fluorescent lamp used, for example, as a back light in a liquid crystal display device (National Convention of Luminance Society (1992), Preliminary Report No. 42, Laid-open Japanese Patent Application No. (Tokkai Hei) 5-290811, U.S. Pat. No. 4,275,330). Furthermore, another method for improving starting property of an electrodeless fluorescent lamp is to fill the discharge space inside a bulb with a radioactive material (e.g., Gregory Zaslavsky, et al. Improved starting of the 100-W Metal Halide Lamp. JOURNAL of the Illuminating Engineering Society 19 (no.1): 76-83 (1990), Published Examined Japanese Patent Application No. (Tokko Sho) 60-34220). In this case, it is possible to obtain initial electrons quickly at the time of lighting by using electrons which arise in accordance with the decay of the radioactive material.

However, when a cathode is impregnated with cesium oxide as proposed above, a sintered electrode is impregnated with cesium oxide, so that the surface of the electrode must be polished after the impregnation process. Otherwise, since a large number of cesium ions, which are emitted through ion bombardment, falls off when a lamp is lit, the tube wall near the electrode is blackened during the initial stage. In addition, since the electrode surface is polished, the number of cesium oxide molecules is insufficient on the electrode surface, so that a starting auxiliary light source will be needed especially when it is lit in a dark environment. Examples of starting auxiliary light source include a UV enhancer disclosed in the publication mentioned above (Gregory Zaslavsky, et al.) and an igniter bulb disclosed in U.S. Pat. No. 4,359,668. However, when a starting auxiliary light source is used, the cost becomes higher and the system becomes considerably complicated. In addition, a tube wall near the electrode is blackened conspicuously even after being lit for a long period of time.

When a radioactive material is filled in discharge space inside a bulb as proposed above, it is necessary to restrict the amount of radiation as much as possible for safe handling of the radioactive material. As a result, it is difficult to obtain a fluorescent lamp with satisfactory starting ability particularly for general use.

Furthermore, another method is proposed in which a conventional product is combined with a a starting auxiliary light source, but this system is relatively complicated and increases costs.

SUMMARY OF THE INVENTION

It is an object of this invention to solve the above-mentioned problems in conventional systems by providing a discharge lamp which has a short starting delay time even at a low temperature including room temperature, without using any starting auxiliary light source or radioactive material.

In order to accomplish these and other objects and advantages, a first discharge lamp of this invention comprises a discharge gas inside a bulb, an electrode part disposed inside the bulb for providing electric power to a discharge space, and a cesium compound positioned so as not to contact the electrode part for emitting electrons into the discharge space when the lamp is first lit.

It is preferable in the above-mentioned first discharge lamp that the position of the cesium compound is placed either on a side of an electrode or between electrodes in order to avoid the electrode part.

A second discharge lamp of this invention is an electrodeless discharge lamp comprising discharge gas inside a bulb, a means for providing electric power to a discharge space disposed outside the bulb, an electrode part is not provided inside the bulb, and a cesium compound is placed in the discharge space for emitting electrons into the discharge space when the lamp is first lit.

It is preferable in the above-mentioned second discharge lamp that the means for providing electric power into the bulb from the outside in the electrodeless discharge lamp comprises a coil wound around the outer surface of the bulb.

Furthermore, it is preferable in the above-mentioned first and second embodiments that the cesium compound comprises at least one compound selected from the group consisting of $Cs_2O$, $Cs_3Sb$, $(Cs)Na_2KSb$, $(Cs,Rb)_3Sb$, $Ag_2O$—Cs, and $W_2O$—Cs.

In addition, it is preferable in the above-mentioned first and second embodiments that the cesium compound comprises cesium oxide ($Cs_2O$).

Also, it is preferable in the above-mentioned first and second embodiments that the cesium compound is present in an amount of 10 μg to 10 mg.

It is preferable in the above-mentioned first and second embodiments that the cesium compound is contained on a metal mesh or a porous sintered metal.

Furthermore, it is preferable in the above-mentioned first and second embodiments that the discharge gas comprises mercury vapour and argon gas.

In addition, it is preferable in the above-mentioned first and second embodiments that the discharge gas has a charging pressure of 10 to 20000 Pa.

Also, it is preferable in the above-mentioned first and second embodiments that a phosphor film is present on an inner surface of the bulb.

According to the first discharge lamp of this invention, discharge gas is filled inside a bulb, an electrode part is disposed inside the bulb for providing electric power to a discharge space, and a cesium compound is placed in a position so as to avoid and not to contact the electrode part for emitting electrons into the discharge space at the onset of lighting. As a result, the discharge lamp has a short starting delay time even at a low temperature including room temperature without using any starting auxiliary light source or radioactive material. In other words, the work function of the cesium compound is relatively small, and a surface barrier which is necessary for electrons inside a solid body to uncouple out of the solid body is low. When the cesium compound is disposed in a position that avoids an electrode part inside a bulb, electrons can be emitted to the discharge space only by providing a small amount of photoelectrons or thermal energy, so that it is possible to light the lamp smoothly. Furthermore, the problems mentioned earlier in the conventional system are solved, that is, it is no longer necessary to polish the electrode surface, or a cesium compound does not fall off to cause blackening, so that a discharge lamp having excellent starting ability can be obtained.

When the cesium compound, which is placed so as to avoid the electrode part, is positioned either on a side of an electrode or between electrodes, the starting delay time can be shortened even more without negatively affecting discharge.

According to the second discharge lamp of this invention, the discharge lamp is an electrodeless discharge lamp characterized in that discharge gas is filled inside a bulb, a means for providing electric power to discharge space is disposed outside the bulb, an electrode part is not provided inside the bulb, and a cesium compound is placed in an optional position in the discharge space for emitting electrons into the discharge space when the lamp is first lit. According to the same effects mentioned earlier in the first invention, the discharge lamp which has a short starting delay time even at a low temperature including room temperature can be attained without using any starting auxiliary light source or a radioactive material.

A particularly useful means for providing electric power into the bulb from the outside in the electrodeless discharge lamp is from a coil wound around the outer surface of the bulb.

Furthermore, when the cesium compound comprises at least one compound selected from the group consisting of $Cs_2O$, $Cs_3Sb$, $(Cs)Na_2KSb$, $(Cs,Rb)_3Sb$, $Ag_2O$—Cs, and $W_2O$—Cs in the above-mentioned first and second inventions, the starting speed can be even higher.

In addition, when the cesium compound comprises cesium oxide ($Cs_2O$) and is present in an amount of 10 μg to 10 mg, the starting speed can be increased even more. The particularly preferable amount is in the range of 100 μg to 1 mg.

Also, when the cesium compound is held by a metal mesh or a porous sintered metal, the starting delay time can be shortened even more without netatively affecting discharge. The operation can take place stably over a long time.

It is preferable to use a discharge gas comprising mercury vapour and argon gas.

Furthermore, it is preferable for the charging pressure of the discharge gas to be from 10 to 20000 Pa.

In addition, it is practical that a phosphor film is present on an inner surface of the bulb.

DETAILED DESCRIPTION OF THE INVENTION

This invention will be explained in detail with reference to the attached figures and the following examples. The examples are illustrative and should not be construed as limiting the invention in any way.

EXAMPLE 1

Figure 1:
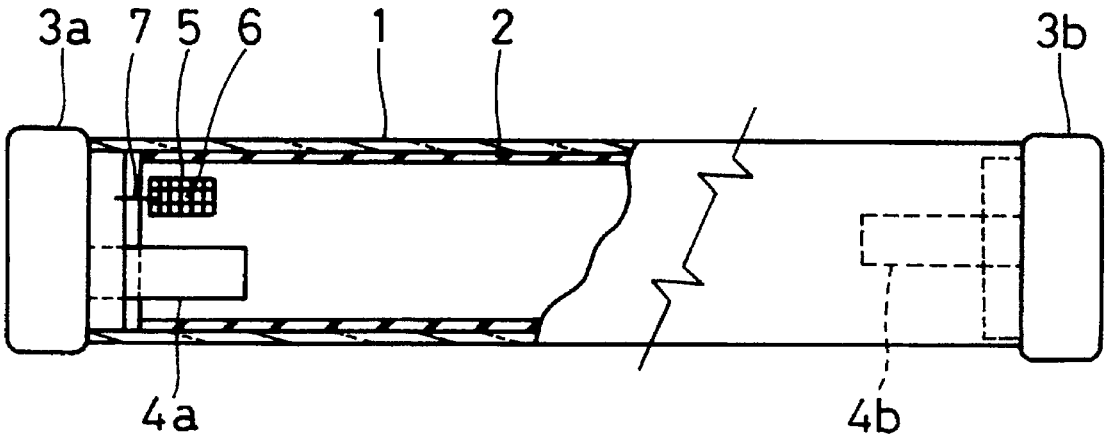
FIG. 1 is a front view partly in section showing a cold-cathode fluorescent lamp of Example 1 in this invention.

A cold-cathode fluorescent lamp shown in FIG. 1 is provided with a bulb 1 made of glass having an outer diameter of 4 mm, a length of about 30 mm, and a thickness of 0.3 mm and a phosphor film 2 applied on the inner surface. The lamp was filled with mercury vapour (dripping 3 mg of Hg) and argon (Ar) gas at a pressure of 10000 Pa. In this embodiment, the phosphor was created by blending three types of rare earth phosphors comprising blue $(Sr, Ca, Ba)_{10}(PO_4)_6Cl_2:Eu^{2+}$, green $LaPO_4$:Ce, Tb, and red $Y_2O_3:Eu^{3+}$ and formed with a thickness of about 20 μm. Next, bases 3*a*, 3*b* were positioned at both ends of the bulb 1, and sintered electrodes 4*a*, 4*b* were sealed on the inside of each base. A metal mesh 5 was disposed near the side of one of the sintered electrodes 4*a* (almost next to the electrode and away therefrom about 2 mm) by way of a supporting arm 7 (size: 1 mm×4 mm, mesh: 25/inch, thickness: 0.15 mm). On the surface of the metal mesh 5, cesium oxide 6 having a work function of about 1 eV was applied in an amount of about 200 μg. A method of applying cesium oxide comprises the steps of dissolving a crystal of cesium oxide ($Cs_2O$) with 30 wt. % concentration in water, dipping the metal mesh 5 and lifting it, and drying it under $N_2$.

Next, the starting property of the above-configured fluorescent lamp and starting properties of conventional fluorescent lamps were compared.

Two kinds of conventional fluorescent lamps A, B are used in this comparative test. One of the conventional products A uses a sintered electrode as one of a pair of electrodes which is impregnated with cesium oxide and is polished on the surface. The other conventional product B is a cold-cathode fluorescent lamp which does not contain cesium oxide at all. Here, the amount of cesium oxide being impregnated in the sintered electrode of the conventional product A was about 200 μg before the polishing process. However, due to the surface polishing, the raised portions of the surface of the sintered electrode were rubbed off, so that less than 50% of the initial amount of cesium oxide impregnated in the sintered electrode remained and was present in surface depressions.

20 samples of the cold-cathode fluorescent lamp in this embodiment (product of this invention) as well as 20 samples each of the conventional products A and B were prepared in the comparative test. After these lamps were lit, they were left in a dark environment for more than 48 hours, and subsequently, alternating current voltage (high-frequency applied voltage: 400 V (effective value), frequency: about 35 kHz) capable of starting the lamp was applied between both bases 3*a* and 3*b* in the dark with an ambient temperature of 0° C. Time elasped before lighting begin was measured, and values (starting delay time) with starting probability of 50% were obtained. The results are shown Table 1 below.

TABLE 1

| Starting delay time (50% accumulated average value) | |
|---|---|
| Product of this invention | 8 ms |
| Conventional product A | 200 ms |
| Conventional product B | 10,000 ms |

As clearly shown in Table 1, the product of this invention has approximately 1/1000 times shorter starting delay time than conventional product B. On the other hand, when the product of this invention is compared with conventional product A, the product of this invention proves to have better starting capability than the conventional product A. This is due to the difference in the number of cesium oxide molecules which contact the discharge space. Furthermore, the reason why both the product of this invention and the conventional product A have better starting properties in a dark environment than the conventional product B is because even if cesium oxide having a work function of about 1 eV and solid surface temperature of 0° C. is present, thermal energy allows a considerable number of electrons to break off from the solid surface. The electrons obtained in this way could have been initial electrons at the time when the lamp started.

In addition, the tube wall near the electrode was not conspicuously blackened in the product of this invention even after lighting over a long period of time.

EXAMPLE 2

Figure 2:
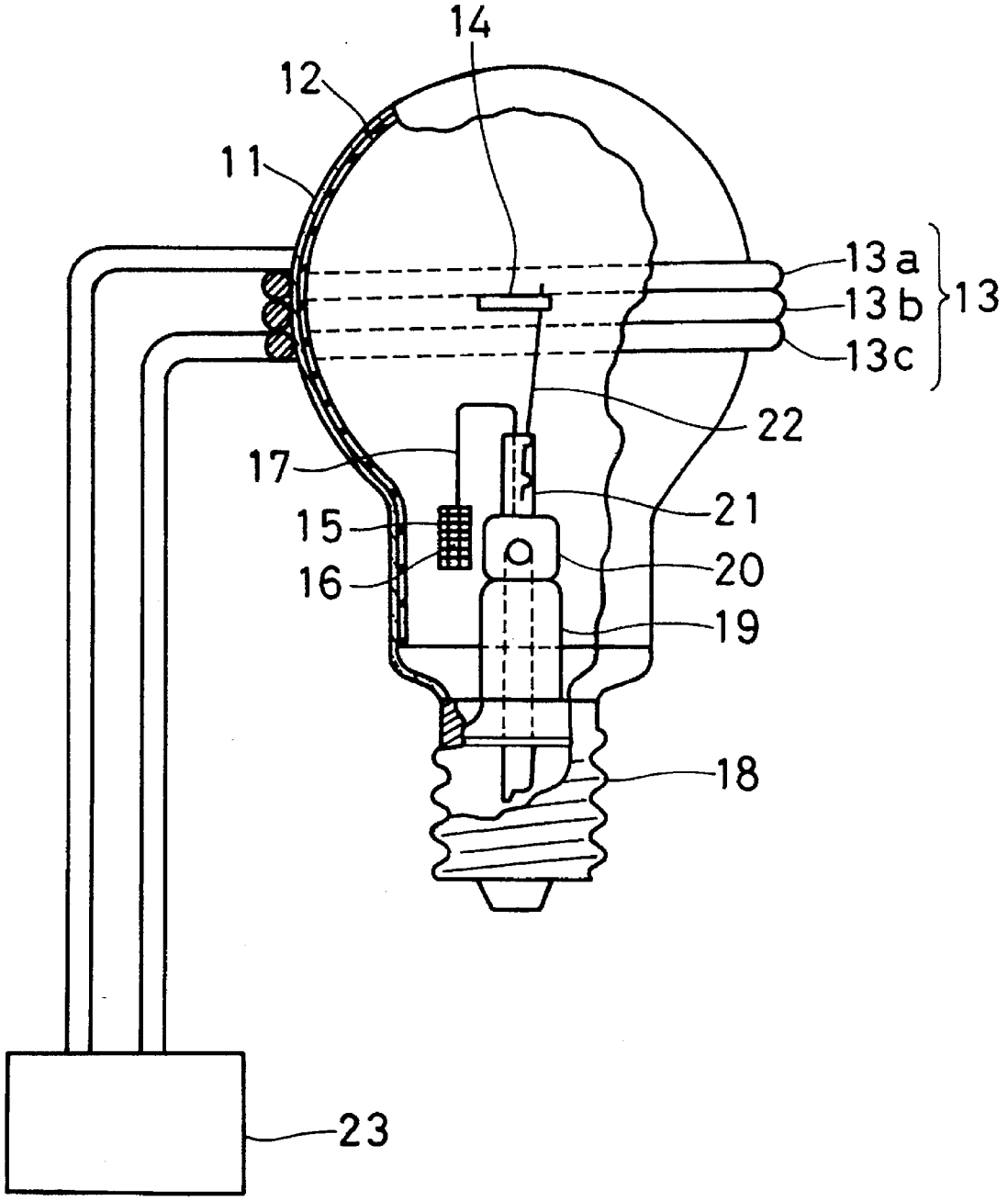
FIG. 2 is a front view partly in section showing an electrodeless fluorescent lamp of Example 2 in this invention.

An electrodeless fluorescent lamp shown in FIG. 2 comprises a spherical bulb 11 with an outer diameter of 45 mm and a phosphor film 12 on the inner surface as in Example 1. Mercury vapour (dripping 3 mg of Hg) and argon (Ar) gas were filled inside the bulb 11 with a pressure of 130 Pa. Also, a coil 13 (13*a*, 13*b*, 13*c*) for generating high-frequency electric current is wound around an outer surface of the bulb 11. In addition, a ring 14 having both a mercury supplying function and a getter function (the product of the firm SAES GETTERS CO., LTD. under the trade name "ST101.505/○/7-2") and a metal mesh 16 (size: 4 mm×7 mm, mesh: 25/inch, thickness: 0.15 mm) applied with about 650 μg of cesium oxide 15 are disposed by a supporting arm 17 contacting discharge space inside the bulb 11. A method of applying cesium oxide comprises the steps of dissolving a crystal of cesium oxide ($Cs_2O$) with 10 wt. % concentration in water, dipping the metal mesh 16 and lifting it, and drying it under $N_2$. 18 represents a base for fixing a lamp; 19 represents a lower stem part; 20 represents an upper stem part; 21 represents an insertion part of the supporting arm; 22 represents a ring supporting arm; and 23 represents a lighting device for providing high-frequency electric current into the coil. In the above-mentioned configuration, the lower stem part 19, the upper stem part 20, and the insertion part of the supporting arm 21 are all made of glass and are molded together into one body.

Figure 3:
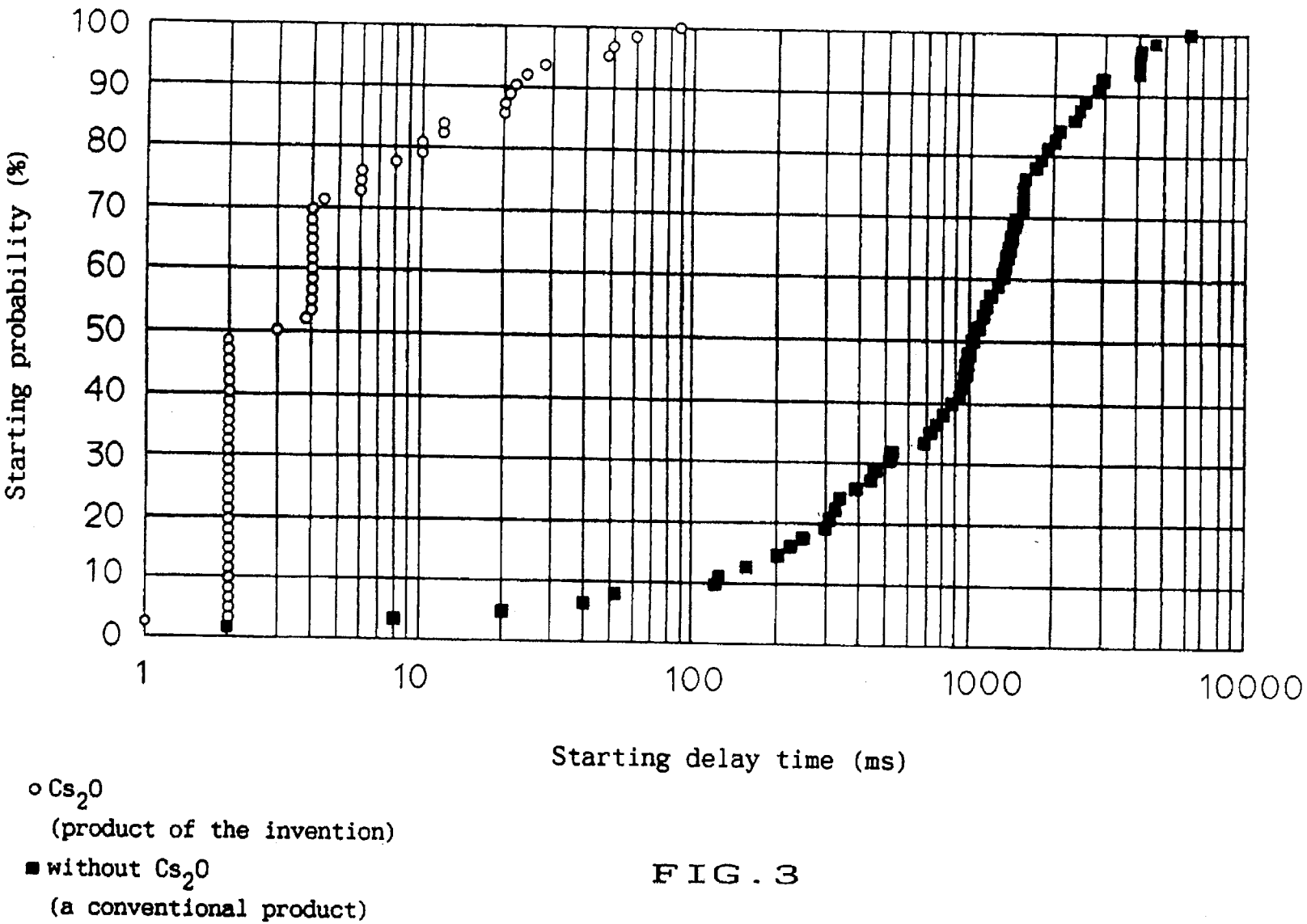
FIG. 3 is a graph showing starting delay time and starting probability in dark ambience of Example 2 and a conventional example.

60 samples of the above-configured fluorescent lamp of this embodiment as well as 60 samples of a conventional product (without $Cs_2O$) were prepared. These lamps were lit once and then turned off, and they were left in a bright environment for 8 hours. Subsequently, these lamps were left in a dark environment for 16 hours. Next, after the lamps were placed in a dark environment with an ambient temperature of 25° C., 500 V of high-frequency voltage was applied to the coil 13 which has a diameter of 1.6 mm and is wound around the bulb 11 in three turns with a pitch of 2 mm (between the upper end coil 13*a* and the lower end coil 13*c*, zero to peak value: frequency 13.56 MHz). Time needed until the lamps started lighting was measured, and the results are shown FIG. 3. FIG. 3 shows starting probability against each starting delay time.

As clearly shown in FIG. 3, it was confirmed that the fluorescent lamp of this embodiment (white circle) could be started in much shorter time than the conventional product (black rectangle). For example, when starting probabilities at 50% were compared, the fluorescent lamp of the invention had a shorter starting delay time of more than 1/300 compared with the conventional product. This is due to the fact that, at the time of starting, voltage is applied between the upper end 13*a* and the lower end 13*c* of the coil 13, and electrons emitted from the cesium oxide 15 by an electric field spreading into the bulb 11 are subject to acceleration effects. As a result, it is possible to light the lamp more smoothly. The blackening of the tube wall caused by the cesium oxide 15 was negligible.

Also, a cold-cathode fluorescent lamp and an electrodeless fluorescent lamp were used in the above-mentioned embodiments, but this invention can be similarly applied to any other discharge lamp including a fluorescent lamp.

Figure 4:
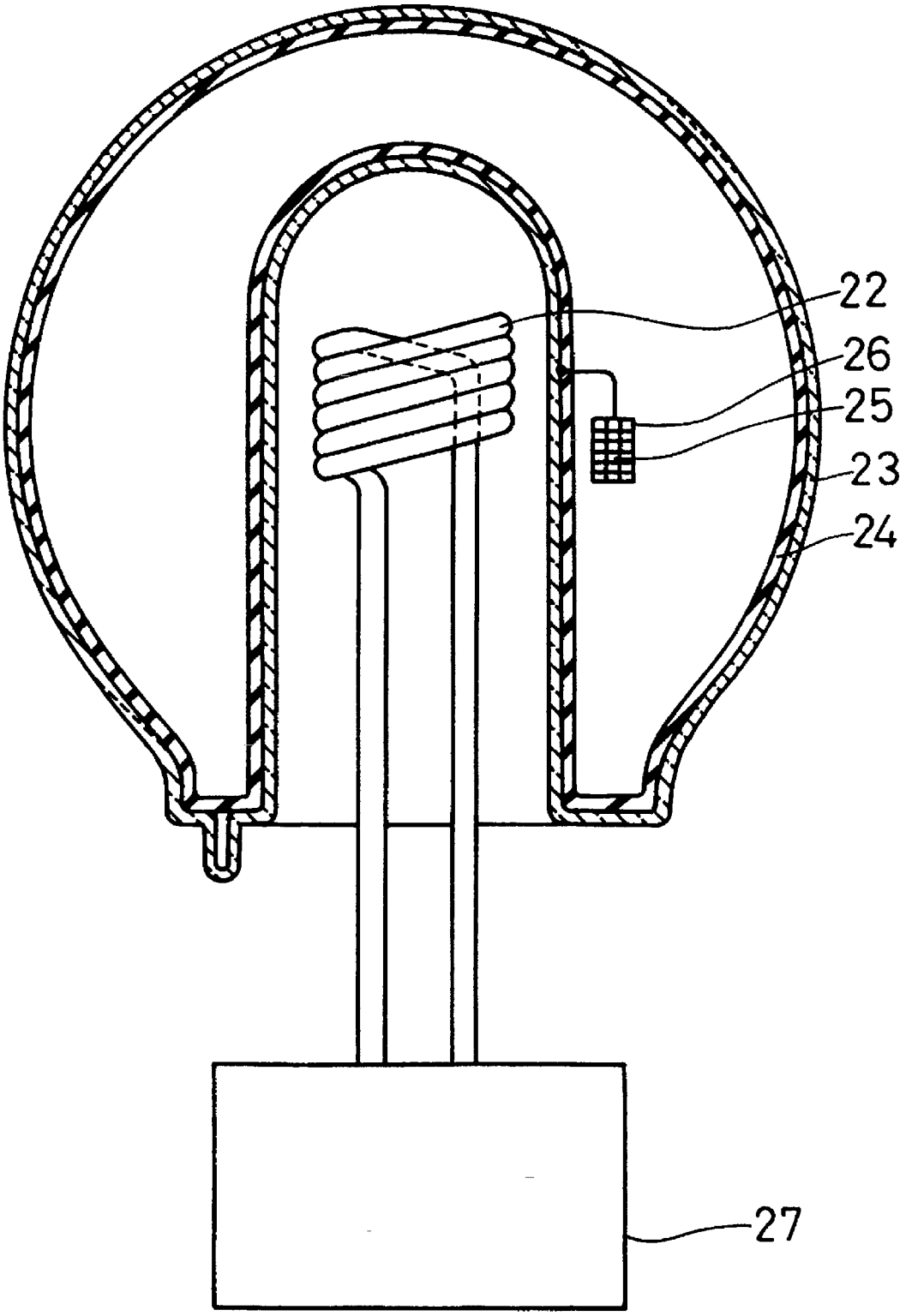
FIG. 4 is a front view partly in section showing an electrodeless fluorescent lamp of another embodiment in this invention.

Furthermore, as shown in FIG. 4, the same effects as that of Example 2 mentioned above can be obtained by using an electrodeless fluorescent lamp equipped with a coil 22 for providing high-frequency electric current which is covered with a bulb 23 and also positioned outside the discharge space of the bulb 23. In FIG. 4, 24 represents a phosphor; 25 represents cesium oxide; 26 represents a coated metal mesh; and 27 represents a high-frequency electric source.

The invention may be embodied in other forms without departing from the spirit or essential characteristics thereof. The embodiments disclosed in this application are to be considered in all respects as illustrative and not as restrictive. The scope of the invention is indicated by the appended claims rather than by the foregoing description, and all changes which come within the meaning and range of equivalency of the claims are intended to be embraced therein.

What is claimed is:

1. A cold cathode mercury discharge lamp comprising a bulb, a discharge gas in a discharge space inside the bulb at a pressure of 10 to 20000 Pa, a pair of electrodes disposed inside the bulb for providing electric power to the discharge space, wherein cesium oxide which emits electrons into the discharge space at lamp ignition in dark ambience is disposed inside the bulb and positioned so as not to contact the electrodes.

2. The discharge lamp as in claim 1, wherein an amount of the cesium oxide is 10 μg to 10 mg.

3. The discharge lamp as in claim 1, wherein the cesium oxide is disposed on a side of the electrode or between the electrodes.

4. The discharge lamp as in claim 1, wherein the cesium oxide is contained in a metal mesh or a porous sintered metal.

5. The discharge lamp as in claim 1, wherein the discharge gas comprises mercury vapour and argon gas.

6. The discharge lamp as in claim 1, wherein the discharge gas has a charging pressure of 10 to 20000 Pa.

7. The discharge lamp as in claim 1, wherein a phosphor film is present on the inner surface of the bulb.

8. An electrodeless low pressure mercury discharge lamp comprising an electrodeless bulb, a discharge gas filled in a discharge space inside the bulb, means for providing electric power to the discharge space disposed outside the bulb, wherein a cesium oxide which emits electrons into the discharge space at the lamp ignition in dark ambience is disposed inside the bulb.

9. The discharge lamp as in claim 8, wherein the means for providing electric power into the discharge space in the bulb from the outside of the bulb comprises a coil wound around the outer surface of the bulb.

10. The discharge lamp as in claim 8, wherein the means for providing electric power into the discharge space in the bulb from the outside of the bulb comprises a coil which is covered with a second bulb positioned outside the discharge space of the bulb.

11. The discharge lamp as in claim 8, wherein an amount of the cesium oxide is 10 μg to 10 mg.

12. The discharge lamp as in claim 8, wherein the cesium oxide is contained in a metal mesh or a porous sintered metal.

13. The discharge lamp as in claim 8, wherein the discharge gas comprises mercury vapour and argon gas.

14. The discharge lamp as in claim 8, wherein the discharge gas has a charging pressure of 10 to 20000 Pa.

15. The discharge lamp as in claim 8, wherein a phosphor film is present on the inner surface of the bulb.

* * * * *